US011313645B2

(12) United States Patent
Guth

(10) Patent No.: US 11,313,645 B2
(45) Date of Patent: Apr. 26, 2022

(54) MORTAR WEAPON

(71) Applicant: Rheinmetall Waffe Munition GmbH, Unterlüß (DE)

(72) Inventor: Sven Guth, Neuenburg/Baden (DE)

(73) Assignee: Rheinmetall Waffe Munition GmbH, Unterlüß (DE)

( * ) Notice: Subject to any disclaimer, the term of this patent is extended or adjusted under 35 U.S.C. 154(b) by 0 days.

(21) Appl. No.: 17/043,156

(22) PCT Filed: May 24, 2019

(86) PCT No.: PCT/EP2019/063517
§ 371 (c)(1),
(2) Date: Sep. 29, 2020

(87) PCT Pub. No.: WO2019/238392
PCT Pub. Date: Dec. 19, 2019

(65) Prior Publication Data

US 2021/0148673 A1 May 20, 2021

(30) Foreign Application Priority Data

Jun. 11, 2018 (DE) ..... 10 2018 113 916.0

(51) Int. Cl.
*F41F 1/06* (2006.01)
*F41A 23/54* (2006.01)
(Continued)

(52) U.S. Cl.
CPC ..... *F41F 1/06* (2013.01); *F41A 23/54* (2013.01); *F41A 23/06* (2013.01); *F41A 23/34* (2013.01)

(58) Field of Classification Search
CPC .. F41F 1/06; F41A 23/54; F41A 23/06; F41A 23/34
(Continued)

(56) References Cited

U.S. PATENT DOCUMENTS 1,524,273 A * 1/1925 Newton ..... F41F 1/00 89/1.3
2,444,334 A 6/1948 Caulkins
(Continued)

FOREIGN PATENT DOCUMENTS

CA 2742535 C 9/2016
DE 10 2011 105 303 A1 12/2012
(Continued)

OTHER PUBLICATIONS

International Search Report from corresponding PCT Application No. PCT/EP2019/063517, dated Jul. 29, 2019.

*Primary Examiner* — Bret Hayes
(74) *Attorney, Agent, or Firm* — Harness, Dickey & Pierce, P.L.C.

(57) ABSTRACT

The invention relates to a combination mortar weapon (1) with a base (4) and mortar barrel (12). A frame (7) with a receiving area (8) for receiving an additional base (10) is attached to the base (4). The base (4) belongs to a standard mortar (2) and the additional base (10) belongs to a commando mortar (3). The mortar barrel (12) is secured to the additional base (10) of the commando mortar (3). The mortar barrel (12) is used by the standard mortar (2) and by the commando mortar (3). The connection between the base (4) of the standard mortar (2) and the base (10) of the commando motor (3) is produced at least by a rapid-action closure (11). The frame (7) comprises an arm (13), to which a monopod (14) is attached as the support device and for the purpose of elevating the mortar barrel (12).

13 Claims, 8 Drawing Sheets

(51) Int. Cl.
*F41A 23/06* (2006.01)
*F41A 23/34* (2006.01)

(58) Field of Classification Search
USPC ..... 89/1.35, 37.05, 40.02
See application file for complete search history.

(56) References Cited

U.S. PATENT DOCUMENTS

| | | | | | |
|---|---|---|---|---|---|
| 2,557,960 | A | | 6/1951 | Gerhardt | |
| 2,694,342 | A | | 11/1954 | Yves | |
| 2,790,357 | A | * | 4/1957 | Garrett | F41F 1/06 89/43.01 |
| 3,303,742 | A | | 2/1967 | Thierry et al. | |
| 3,760,684 | A | * | 9/1973 | LaSpisa | F41F 1/06 89/37.05 |
| 4,059,820 | A | * | 11/1977 | Turpening | G01V 1/108 367/140 |
| 4,721,026 | A | | 1/1988 | Arana Ibarra | |
| 6,321,632 | B1 | | 11/2001 | Holmes et al. | |
| 6,708,596 | B2 | * | 3/2004 | Ang | F41A 25/20 89/37.05 |
| 2012/0024135 | A1 | | 2/2012 | Kohnen et al. | |
| 2012/0132059 | A1 | | 5/2012 | Kohnen et al. | |

FOREIGN PATENT DOCUMENTS

| | | | |
|---|---|---|---|
| FR | 1206603 | A | 2/1960 |
| KR | 10-2015-0062466 | A | 6/2015 |
| WO | WO-2007/064442 | A2 | 6/2007 |
| WO | WO-2010/051902 | A1 | 5/2010 |

* cited by examiner

MORTAR WEAPON

CROSS REFERENCE TO RELATED APPLICATIONS

This application is a national phase entry of PCT/EP2019/063517, filed on 24 May 2019, which claims priority to and the benefit of German Patent Application No. 10 2018 113 916.0, filed on 11 Jun. 2018, the entire contents of which are incorporated herein by references.

FIELD

The invention relates to a grenade launcher or a mortar weapon which is configured or can be deployed as a standard and commando mortar. In other words, the grenade launcher or mortar weapon can be deployed firstly as a standard mortar and secondly as a commando mortar. The two mortars are structurally connected to one another for this purpose.

BACKGROUND

The need for commando special forces to have a weapon which is capable of providing indirect fire support in commando operations has led to the infantry identifying a gap in capability too. A weapon is required which is capable of being deployed with direct and indirect alignment. The direct alignment range should be between 100 m and 1500 m; the indirect alignment range up to 3500 m. Indirect alignment takes place with the help of a base plate and bipod.

DE 10 2011 105 303 A1 discloses a fire control device for at least one manually aimed weapon, in particular a mortar. Apart from an optical sighting device with a device for measuring distance, a computing device for determining the desired angle of elevation and the desired azimuth angle, the weapon also has display means for showing that the actual azimuth angle and the desired azimuth angle agree.

60 mm mortars which can be converted by means of conversion kits from a basic mortar with a base plate, a barrel, alignment means and a bipod—a so-called standard mortar—into a commando mortar comprising only a barrel are known in practice. The mortar is then no longer oriented by means of cranks on the lateral and vertical adjustment, but by the gunner holding and aligning the barrel himself. Where a grenade launcher is deployed as the commando launcher, the barrel is supported on the ground using a spike. In some embodiments, the gunner may set to a type of ammunition and range scale. Readjustment involves a vertical and horizontal spirit level with which the previously set vertical and lateral direction can be set. An experienced gunner is needed in both cases. The bipod, alignment means and base plate remain unused. The disadvantage is that the unused assemblies of the standard mortar still have to be carried along. Modification of the spike and replacement with the base plate, or vice versa, then takes place on site. Quick-release fastenings are provided for this purpose, so that a spike can be attached to the barrel instead of the base plate, or vice versa.

The M6 C-640 Mk mortar from Hirtenberger, also referred to as a 60 mm commando launcher, has been developed based on the 60 mm bipod system (M6-1000) and has a quick-change system by means of which the commando launcher can be removed from the base plate of the standard launcher with bipod or fastened to it again.

SUMMARY

The problem addressed by the invention is that of disclosing a further possibility for quickly adapting a standard mortar into a commando mortar, and vice versa.

The problem is solved by the features of patent claim 1. Advantageous embodiments are contained in the dependent claims.

The idea underlying the invention is that of creating a mortar weapon which can be used firstly as a standard mortar and secondly as a commando mortar. The two are structurally combined for this purpose. A "2-in-1" system is created.

Standard mortars and commando mortars each have their own base plate. The base plate of the commando mortar can be accommodated by a base plate of the standard mortar. For this purpose, the standard mortar comprises a larger base plate than the commando mortar, so that the smaller base plate of the commando mortar can be inserted in the larger base plate of the standard mortar. The base plate of the commando mortar is therefore part of the standard mortar set. Standard and commando mortars have a common barrel. The barrel is detachably fastened to the base plate of the commando mortar. Before or during deployment, a decision can be made as to which version is required. An opportunity is therefore created to decide whether only the lightweight commando mortar variant should be carried during a rapid retreat. The base plate of the standard mortar could be left behind in this case.

A frame on the base plate of the standard mortar is used for the alignment in azimuth. The frame can be released or fixed in respect of the base plate of the standard mortar via an azimuth adjuster. The azimuth adjuster can preferably be a high-speed and precision adjuster in the form of a thumb wheel. This thumb wheel preferably has a friction grip element on the underside. This may be a rubber, for example. The friction grip element creates a frictional connection between the rotatable frame and the base plate of the standard mortar. For a quick approximate alignment in azimuth, this friction grip can be disengaged. In this way, the frame is released and can be turned by hand in respect of the base plate. Fine alignment of the standard mortar or barrel is then achieved by means of a thumb wheel of the azimuth adjuster and the reinstated frictional engagement.

Furthermore, the basic idea underlying the invention is that of dispensing with a bipod which would otherwise be necessary for the standard mortar. Instead, a so-called monopod is preferred. This monopod can be fastened to the frame of the base plate of the standard mortar. For this purpose, the monopod supporting device can be fastened firstly to the frame of the standard mortar and secondly to the barrel. The two fastening points should preferably be detachable. The supporting device is preferably held or mounted in the two fastening points in a rotatable manner. The supporting device should also have a telescopic design. A quick-release mechanism is preferable as the supporting device. By adjusting the barrel, a simultaneous adjustment of the telescope can be achieved, or vice versa. The barrel can be aligned in elevation through the pivotability and height-adjustability of the supporting device—telescopically extendable and/or shortenable. The monopod therefore adopts the function of supporting the barrel and aligning the barrel in elevation.

In order to convert the standard mortar into the commando mortar, the base plate of the commando mortar can be detached from the base plate of the standard mortar. In addition, the monopod can be detached from the barrel. The commando mortar is immediately deployment-ready with the barrel and its base plate. A gunner can hold the commando mortar by hand and aim it. A handle is fastened to the barrel for this purpose. A particular feature of the invention is that the monopod can also remain fastened to the barrel, however. The monopod can then support the alignment of the commando mortar by a gunner. The monopod has a standing mount for this purpose. The underside preferably has a rough surface, for example one provided with teeth.

The joint barrel (mortar barrel) of the commando and standard mortar can be folded back in transport mode. For this purpose, the base plate of the commando mortar is detached from the base plate of the standard mortar by the at least one quick-release fastening. Following detachment of the at least one quick-release fastening, the barrel and the smaller base plate can adopt a position parallel to the larger base plate, for which purpose the monopod is pivoted.

The aforementioned construction is characterized by a compact design. Rapid conversion and rapid deployment of the required mortar are advantageous. In this case, a heavyweight standard mortar can be converted into a lightweight commando mortar, or vice versa. Operation is intuitive and does not require lengthy training. Tools are unnecessary. The quick-release fastenings, or similar, are provided with a securing means, such as a chain, etc., so that they do not get lost in the unused state. The mortar weapon may adopt a safety mode, particularly in its transport position. The range of the mortar weapon lies between 100 m and 1500 m or approx. 3000 m. The angle of elevation should lie between 45° and 85°, in azimuth at around ±25°. These are not so much limiting as more preferred figures.

A combined mortar weapon is therefore proposed which can firstly be deployed as a standard mortar and secondly as a commando mortar. For this purpose, a frame for receiving a further base plate is attached to the base plate. The first base plate is part of the standard mortar and the other base plate of the commando mortar. A mortar barrel can be fastened to the base plate of the commando mortar. The mortar barrel is used by the commando mortar and also by the standard mortar. The commando mortar can therefore be regarded as an integral part of the standard mortar. The base plate of the commando mortar is smaller in diameter than the base plate of the standard mortar. The mechanical connection between the base plate of the standard mortar and the base plate of the commando mortar is created by at least one quick-release fastening. The frame comprises an arm to which a monopod can be fastened as the supporting device and for elevating the mortar barrel. The frame has a rotatable design in respect of the base plate of the standard mortar. In this way, the mortar weapon can be aligned in azimuth when used as a standard mortar. The monopod can be fastened to the frame of the base plate of the standard mortar via a lower quick-release fastening and to the mortar barrel via an upper quick-release fastening. If the mortar weapon is deployed as a commando mortar, the base plate of the commando mortar is detached from the base plate of the standard mortar. Depending on what is required, the lower connection and/or the upper connection can then be detached. The monopod can remain on the base plate or on the mortar barrel in this case. The continued positioning on the mortar barrel has the advantage that the monopod can support the alignment of the commando mortar.

BRIEF DESCRIPTION OF THE DRAWINGS

The invention is to be explained in greater detail with the help of an exemplary embodiment with drawing. In the drawings.

DETAILED DESCRIPTION

Figure 1:
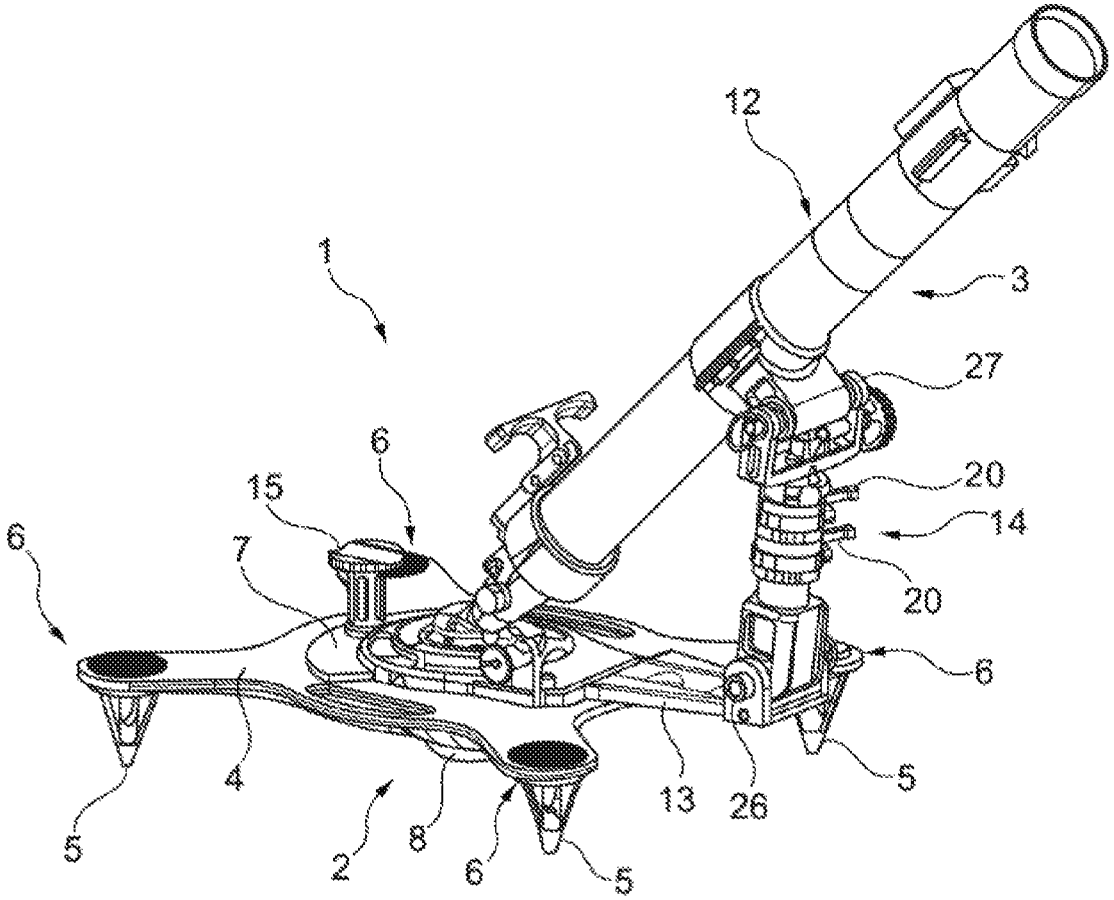
FIG. 1 shows a slightly perspective depiction of a mortar weapon as a standard mortar.

A mortar weapon is depicted as 1 in FIG. 1. The mortar weapon 1 can be used as a standard mortar 2 and as a commando mortar 3, i.e. the mortar weapon 1 can be deployed as a standard mortar 2 or as a commando mortar 3.

As a standard mortar 2, the mortar weapon 1 comprises a first base or floor plate 4. At least one spike 5 is provided on the base plate 4. The at least one spike 5 should be integrated below the base plate 4. The spike 5 acts as a fixed connection between the base plate 4 and the ground. Three spikes 5 may be sufficient for the mortar weapon 1 to be securely supported. Four spikes which are fastened to four projecting ends 6 of the base plate 4 are preferable. The number of spikes 5 should also be dictated by the total weight of the mortar weapon 1, however. The base plate 4 of the standard mortar 2 has a frame 7. The frame 7 is preferably arranged centrally in the base plate 4. The frame 7 contains or comprises a receiving means 8 for receiving the commando mortar 3. A base or floor plate 10 of the commando mortar 3 may be integrated as a further base plate into the receiving means 8.

A mortar barrel 12 of the mortar weapon 1 is connected to the base plate 10 of the commando mortar 3. The mortar barrel 12 can be aligned in azimuth and elevation. For the aligning capability in elevation, a pivoting of the mortar barrel 12 about an axis A is provided. This pivoting axis is located on or in the base plate 10 of the commando mortar 3. On the other hand, the alignment of the standard mortar 3 in azimuth is performed by the frame 7 in the base plate 4 of the standard mortar 2 which is rotatably configured in respect of the base plate 4.

The base plate 10 of the commando mortar 3 is smaller than the base plate 4 of the standard mortar 2. The base plate 10 of the commando mortar 3 can be inserted and fastened in the base plate 4 or the receiving means 8 of the frame 7 on the base plate 4 of the standard mortar 2. This fastening is detachable. There should be at least one quick-action connection 11, e.g. quick-release fastening, for rapid detachment. Threaded connections, bayonet closures, pivoting hooks, etc. can conceivably be used as quick-release fastenings 11.

The frame 7 comprises an arm 13. A monopod 14 is attached to this arm 13 as a support unit. The monopod 14 performs the function of a bipod which is known in practice. The monopod 14 is pivotably fastened to the arm 8 of the frame 7 and can be detached from the arm 13.

Apart from the supporting function, the monopod 14 also assumes the function of aligning the mortar barrel 12 in elevation. For this reason, the monopod 14 is adjustable in terms of length, e.g. it can be telescoped. The alignment in elevation may, for example, take place in predefinable steps (notches) (not shown in greater detail). Preferable, however, is a continuous adjustment by at least one, preferably two, quick-release tightening devices 20, for example.

Furthermore, an azimuth quick-action and precision adjuster is attached to the frame 7 opposite the arm 13 of the frame 7 as a quick-action adjuster 15. This supports alignment of the standard mortar 2 in azimuth.

Figure 2:
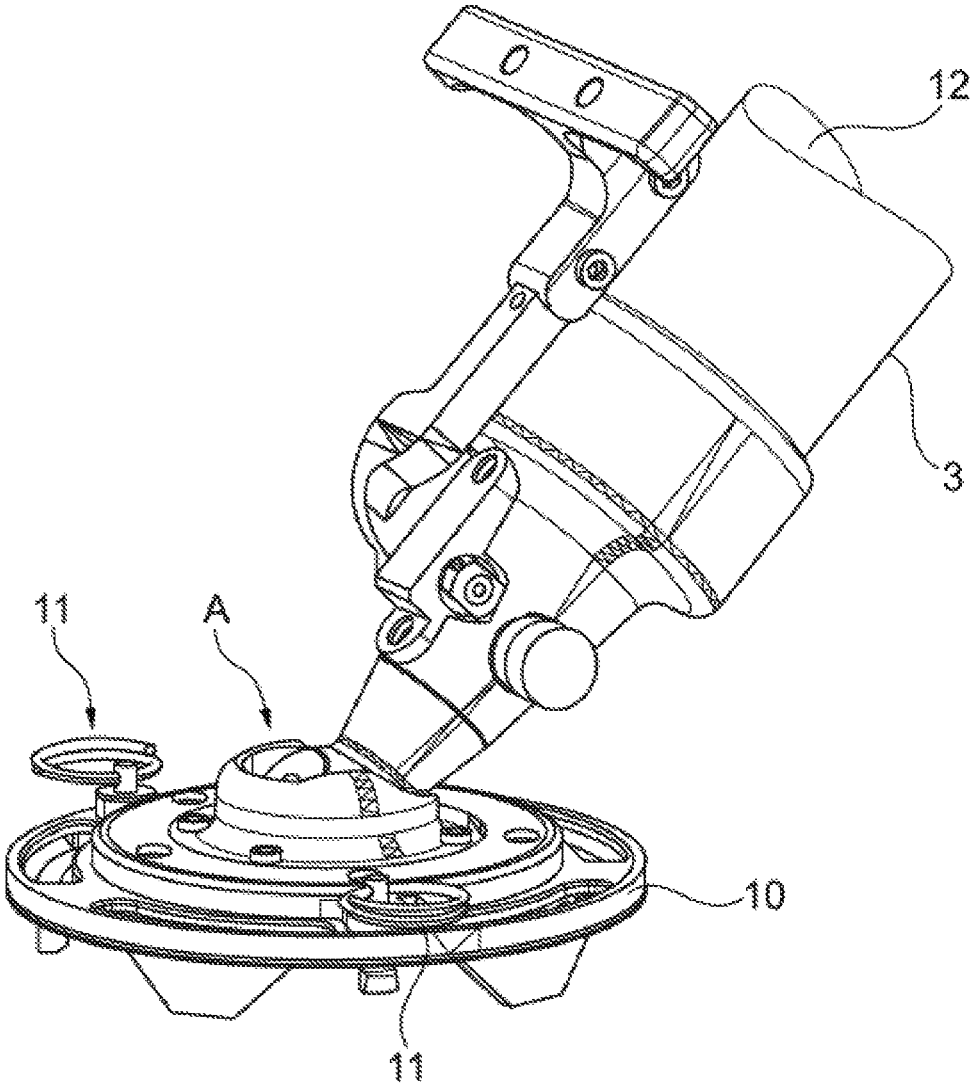
FIG. 2 shows a slightly enlarged perspective depiction of the mortar weapon from FIG. 1 as a commando mortar.

FIG. 2 shows a slightly enlarged lower region of the commando mortar 3 with the at least one quick-release fastening 11, the base plate 10 and the tiltable mortar barrel 12.

Figure 3:
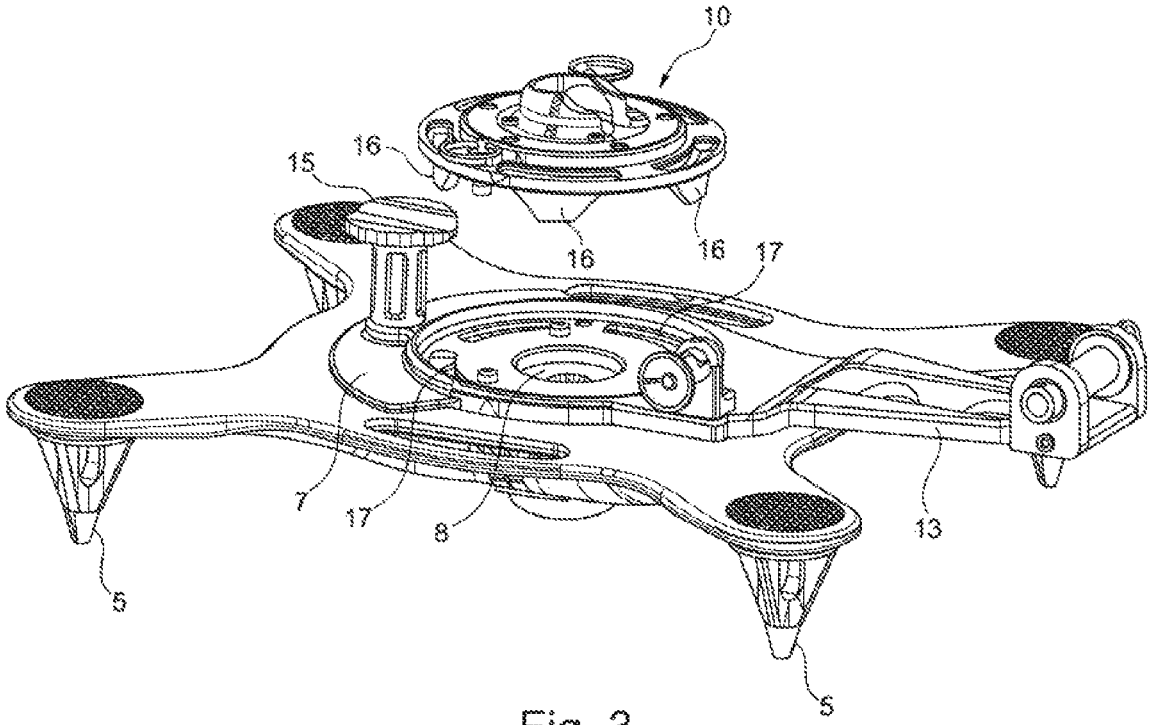
FIG. 3 shows a depiction of the base plate of the standard mortar and the base plate of the commando mortar from FIG. 1 in the separated state.

FIG. 3 depicts the interplay of the two base plates 4, 10 of the mortar weapon 1. The base plate 10 in this case is shown without a mortar barrel 12. The base plate 4, the frame 7, and the receiving means 8 of the standard mortar 2 have a geometry corresponding to the base plate 10. The geometry of the base plate 10 of the commando mortar 3 is in turn geared to the function of the base plate 10 as a commando mortar 3. Since the base plate 10 has at least one spike 16, a recess 17 is provided for the spike 16 in the frame 7 or the receiving means 8. In the present preferred exemplary embodiment, the floor plate 10 of the commando mortar 3 comprises four spikes 16 attached circumferentially below the base plate 10. Accordingly, the receiving means 8 has four recesses 17 for receiving the spikes 16.

Figure 4:
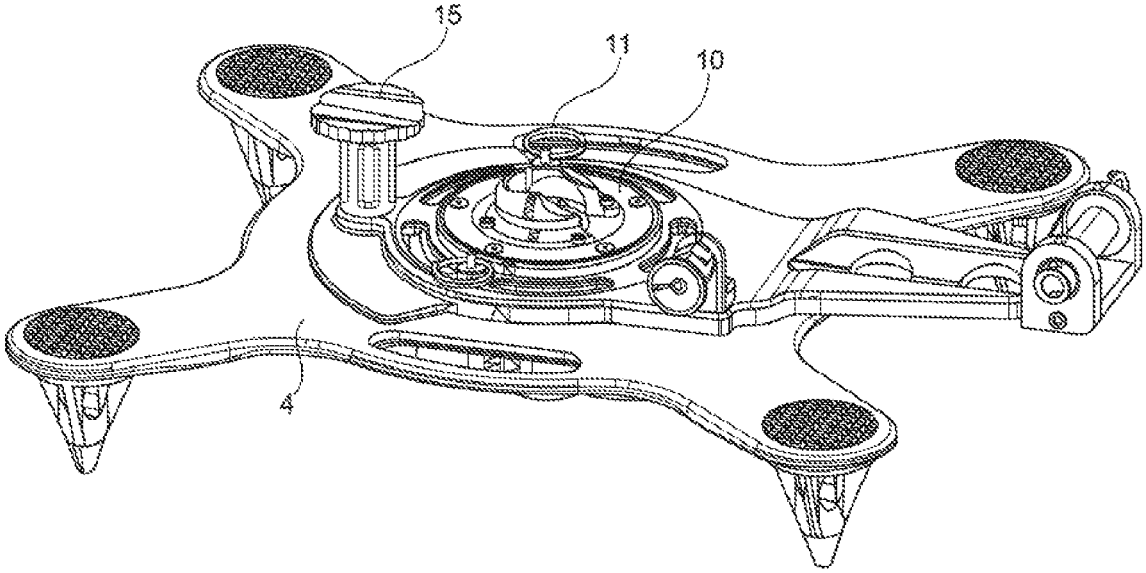
FIG. 4 shows a possible connection of the base plates from FIG. 3, FIG. 5 and FIG. 6 show a depiction of a rotatable and locking device of the standard mortar.

The two base plates 4, 10 are structurally mounted with one another in FIG. 4. The connection or fixing of the base plate 10 in the base plate 4 is created by the at least one quick-release fastening 11.

Figure 5:
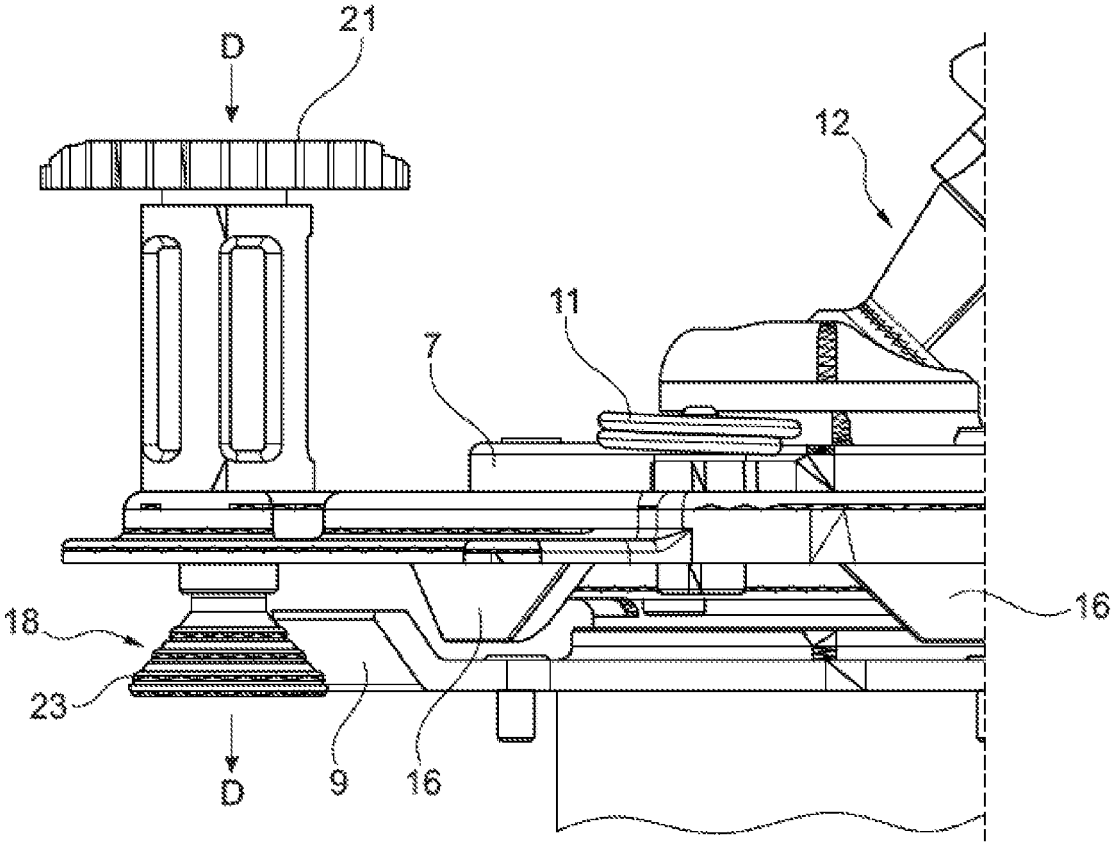
Figure 6:
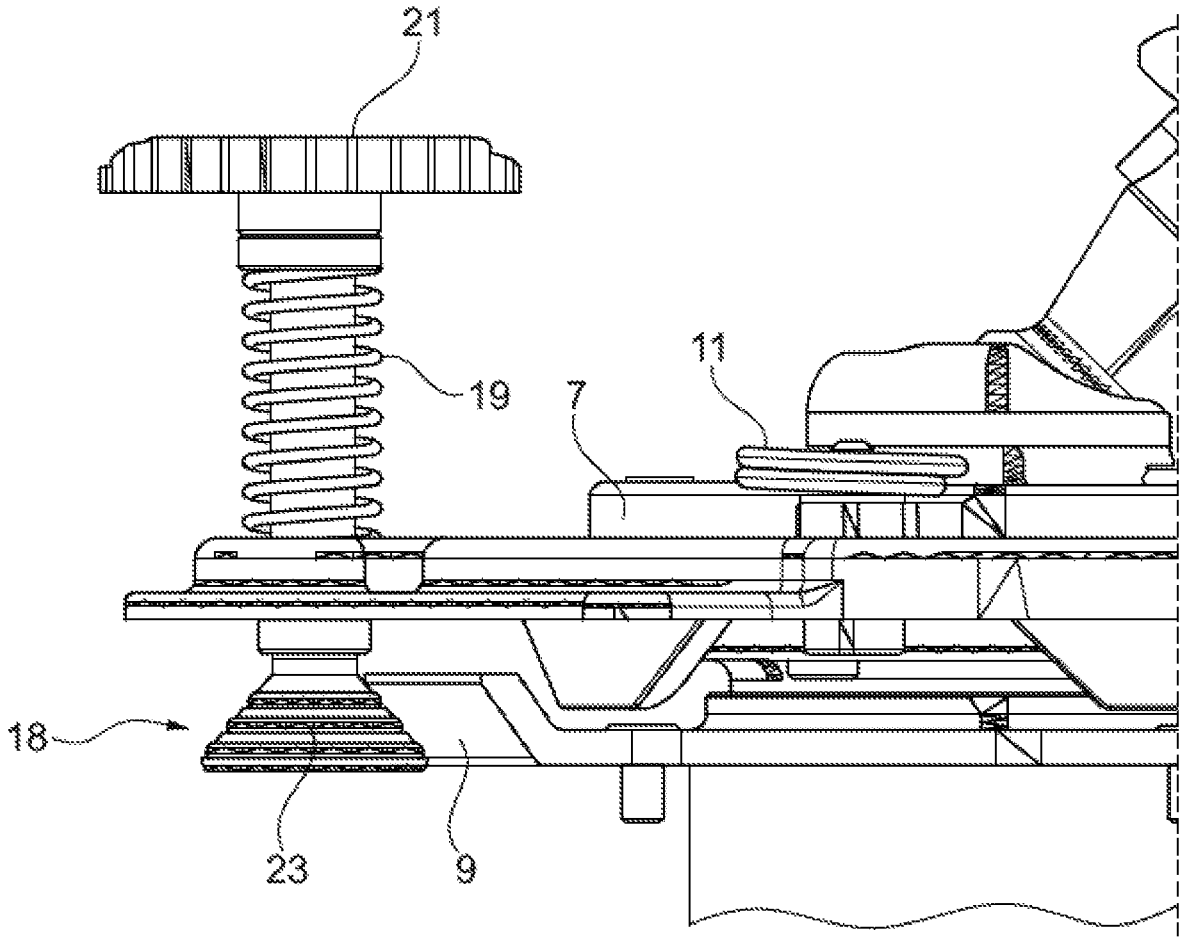

FIGS. 5 and 6 show the quick-action adjuster 15 with which an alignment in azimuth of the mortar barrel 12 of the standard mortar 2 is achieved. The quick-action adjuster 15 is designed as a thumb wheel and has a conical form 18 on the underside. The quick-action adjuster 15 has a spring 19 as the tightening element, in this case a compression spring which is positioned between the thumb wheel 21 and the cone 18.

The quick-action adjuster 15 engages with the cone 18 at a projection 9 of the base plate 4. In this way, a friction grip is created via a friction grip element 23 between the frame 7 and the base plate 4 via the cone 18. A circumferential rubber can be used as the friction grip element 23.

The friction grip between the frame 7 and the base plate 4 can be released by pressure D (FIG. 5). The frame 7 can be quickly turned with the commando mortar 2 without turning the thumb wheel 21. For this purpose, a gunner who is not depicted in greater detail can grip the arm 13 of the frame 7 and adjust, i.e. rotate, the frame 7 in respect of the base plate 4. The friction grip is reinstated by removing the pressure.

For fine alignment, the thumb wheel 21 can then be released (FIG. 6). In this way, a precise and continuous adjustment and precise, continuous alignment of the standard mortar 2 in azimuth can be carried out by turning the thumb wheel 21.

In order to convert the standard mortar 2 into a commando mortar 3, the at least one quick-release fastening 11 is released. In this way, the base plate 4 and the base plate 10 can be separated from one another.

If a commando mortar 3 without a monopod 14 is required, an upper connection 27 of the supporting unit or the monopod 14 to the mortar barrel 12 is detached. The connection 27 is preferably configured in the form of a quick-release fastening. The base plate 10 along with the mortar barrel 12 can then be removed from the standard mortar 2. The base plate 10 and the mortar barrel 12 then form a commando mortar 3.

Figure 7:
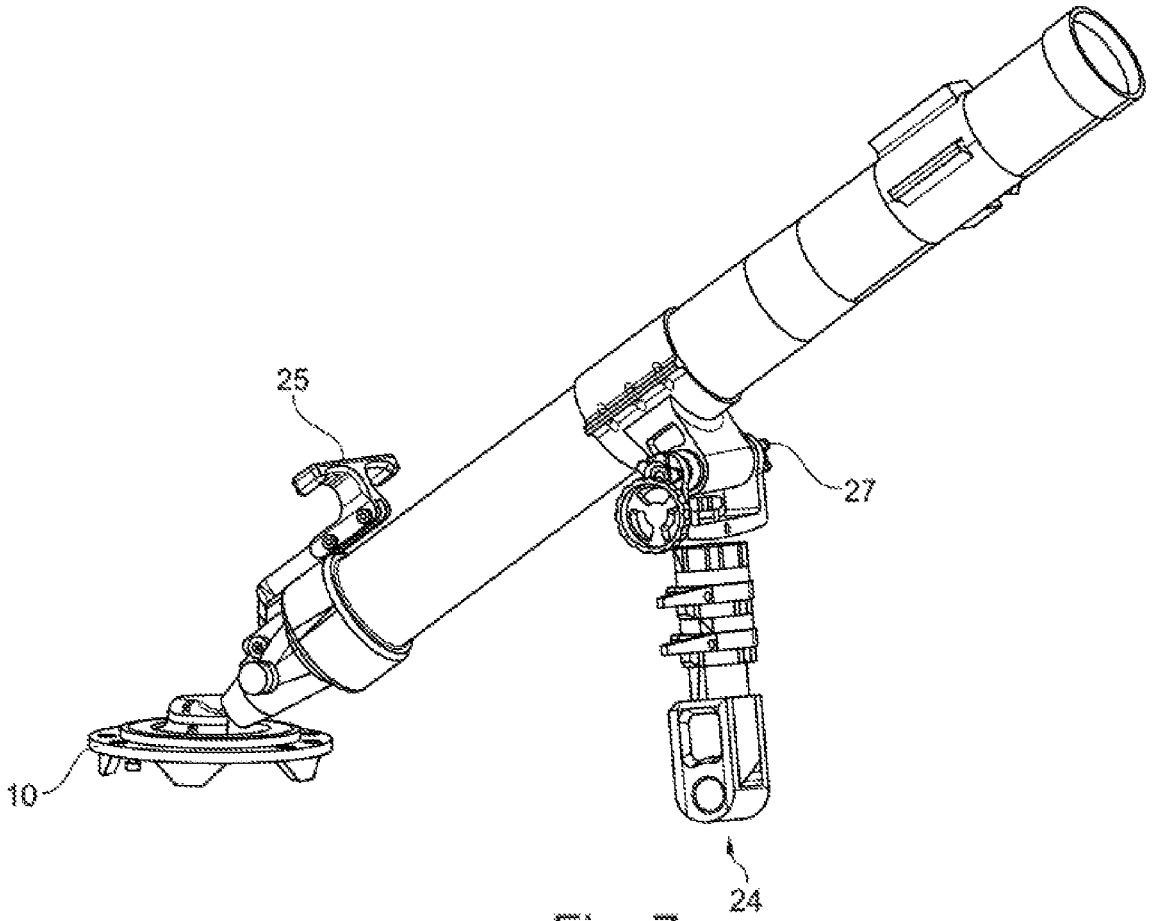
FIG. 7 shows a variant of the commando mortar.

An alternative to the commando mortar 3 is shown in FIG. 7. In this case, a lower connection 26 between the monopod 14 and the frame 7 is detached. The connection 26 in this case is preferably likewise configured as a quick-release fastening. The monopod 14 thereby remains at the mortar barrel 12 and can support the gunner when used as a commando mortar 3 during alignment. For this function, the monopod 14 has a semi-round underside 24 with which the mortar barrel 12 can be placed on the ground or on the earth. The underside 24 preferably has a rough surface. The underside 24 may be provided with teeth for this purpose.

For the alignment of the commando mortar 3, said commando mortar has a handle 25, or the like, for example.

Figure 8:
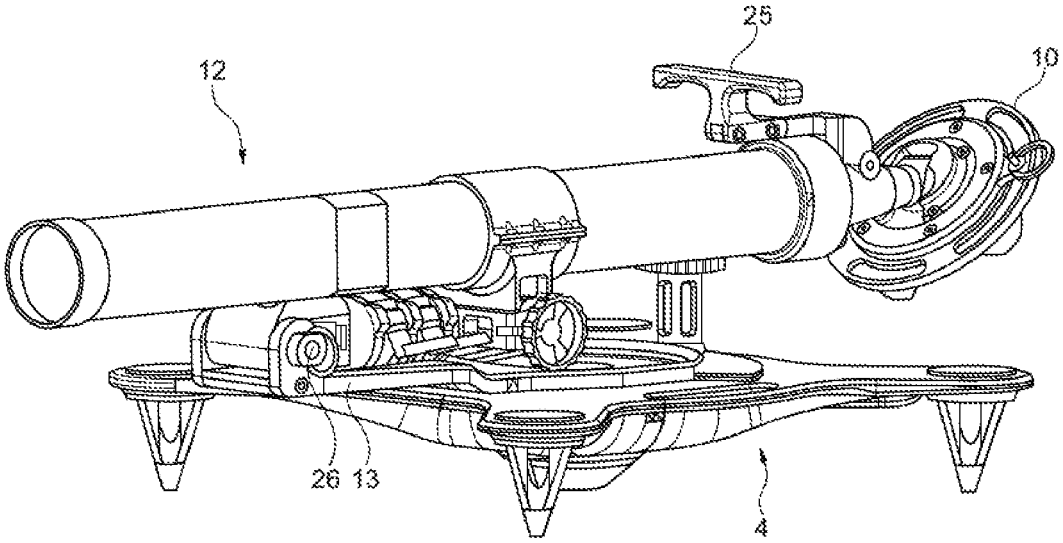
FIG. 8 shows a depiction of the mortar weapon in a transport position.

FIG. 8 shows the mortar weapon 1 in a transport position. For this purpose, the two base plates 4, 10 are separated from one another; the at least one quick-release fastening 11 is released. By folding back the monopod 14, the mortar barrel 12 comes to rest on the base plate 4 of the standard mortar 2.

What is claimed is:

1. A mortar weapon with a base plate, wherein a frame with a receiving means for receiving a further base plate is attached to the base plate, wherein a supporting device is fastened to the frame, wherein the supporting device is a monopod, wherein the further base plate supports a mortar barrel, and wherein the mortar barrel comes to rest above the base plate by folding back the monopod.

2. The mortar weapon as claimed in claim 1, wherein a connection between the base plate and the further base plate is created by at least one quick-release fastening.

3. The mortar weapon as claimed in claim 1, wherein the frame comprises an arm, and wherein the supporting device is fastened to the arm.

4. The mortar weapon as claimed in claim 1, wherein the monopod can be telescoped.

5. The mortar weapon as claimed in claim 1, wherein the monopod has a quick-release tightening device.

6. The mortar weapon as claimed in claim 1, wherein the frame has a rotatable design in respect of the base plate.

7. The mortar weapon as claimed in claim 1, wherein a quick-action adjuster locks the frame in respect of the base plate.

8. The mortar weapon as claimed in claim 7, wherein the quick-action adjuster is designed as a thumb wheel and has a conical form on the underside.

9. The mortar weapon as claimed in claim 7, wherein the quick-action adjuster has a spring as a tightening element, in this case a compression spring.

10. The mortar weapon as claimed in claim 1, wherein the monopod can be fastened to the frame of the base plate via a lower quick-release fastening.

11. The mortar weapon as claimed in claim 1, wherein the monopod can be fastened to the mortar barrel via an upper quick-release fastening.

12. The mortar weapon as claimed in claim 1, wherein the base plate belongs to a standard mortar and the further base plate to a commando mortar.

13. The mortar weapon as claimed in claim 12, wherein the commando mortar is part of the standard mortar.

* * * * *